United States Patent [19]

Fitzpatrick

[11] 4,188,755

[45] Feb. 19, 1980

[54] EXPANDABLE ABRADING TOOL AND ABRASIVE INSERT AND WASHERS THEREOF

[75] Inventor: Paul Fitzpatrick, Fenton, Mich.

[73] Assignee: Ex-Cell-O Corporation, Troy, Mich.

[21] Appl. No.: 897,625

[22] Filed: Apr. 19, 1978

[51] Int. Cl.[2] ..... B24D 17/00

[52] U.S. Cl. ..... 51/206 P; 51/351; 51/378; 51/DIG. 6

[58] Field of Search ..... 51/206 R, 206 P, 206.4, 51/206.5, 331, 338, 339, 345, 350, 351, 352, 372, 375, 378, DIG. 6, 207

[56] References Cited

U.S. PATENT DOCUMENTS

| | | | |
|---|---|---|---|
| 604,933 | 5/1898 | Graham | 51/374 |
| 1,308,019 | 6/1919 | Woodington et al. | 51/206 R |
| 1,792,800 | 2/1931 | Birgbauer | 51/DIG. 6 |
| 1,841,343 | 1/1932 | Tydeman | 51/345 |
| 1,865,229 | 6/1932 | Birgbauer | 51/351 |
| 1,874,856 | 8/1932 | Johnson | 51/345 |
| 1,903,343 | 4/1933 | Roberts | 51/348 |
| 1,906,190 | 4/1933 | Tautz | 51/375 |
| 1,910,658 | 5/1933 | Tydeman | 51/339 |
| 1,960,555 | 5/1934 | Sims | 51/372 |
| 2,282,650 | 5/1942 | Fenton | 51/375 X |
| 2,341,094 | 2/1944 | Hackman et al. | 51/206 R |
| 3,259,959 | 7/1966 | Tobey | 51/206 R X |
| 3,324,607 | 6/1967 | Niemiec | 51/356 |
| 3,462,887 | 8/1969 | Hackman | 51/206 P |
| 3,828,489 | 8/1974 | Culley, Jr. | 51/375 |

FOREIGN PATENT DOCUMENTS

| | | | |
|---|---|---|---|
| 958005 | 2/1957 | Fed. Rep. of Germany | 51/207 |
| 1273360 | 7/1968 | Fed. Rep. of Germany | 51/206.4 |
| 881 | of 1864 | United Kingdom | 51/206.5 |

OTHER PUBLICATIONS

American Machinist, May 21, 1925, p. 827.

*Primary Examiner*—Harold D. Whitehead
*Assistant Examiner*—K. Bradford Adolphson
*Attorney, Agent, or Firm*—Reising, Ethington, Barnard, Perry & Brooks

[57] ABSTRACT

An expandable abrading tool (20, 20*a,* 20*b*) disclosed includes a rotatable arbor (22) and an abrasive insert (24, 24*a,* 24*b*) having stacked washers (26) which receive the arbor and are mounted thereon in a clamped relationship. Each washer has a round outer edge including an abrasive (32) secured thereto for performing a cutting operation upon tool rotation. The washers each have a frustoconical shape that points toward one axial end of the insert. A threaded clamp (38, 40, 42, 44) which provides a means for clamping the ends (34, 36) of the insert is adjustable to increase the clamping force in order to flatten the washers and thereby control the washer diameters. The insert can thus be initially sized for use and can be adjusted to compensate for wear of the abrasive. Different embodiments of the abrasive insert include the washers with slightly smaller spacers (28) interposed therebetween in an alternating relationship, the washers directly engaged with each other, and flutes (46) in the outer edges of the washers. It is preferable but not absolutely necessary that the flutes (46) be aligned in an axial relationship along the insert length. The washers are made from a suitable spring metal, preferably a copper alloy such as bronze with a component such as beryllium, so that the clamping force required to provide the flattening thereof is not too great. The flutes (46) also lessen the required clamping force to flatten the washers.

3 Claims, 7 Drawing Figures

EXPANDABLE ABRADING TOOL AND ABRASIVE INSERT AND WASHERS THEREOF

TECHNICAL FIELD

This invention relates to an expandable abrading tool for use in sizing and finishing holes and also relates to an abrasive insert of the tool and to washers which make up the insert.

BACKGROUND ART

Abrading tools are used to size and surface finish holes during a machining operation in which an abrasive insert of the tool is inserted into the hole and rotated to machine the hole. A relatively small amount of material stock is usually removed during this type of machining operation since the abrasive grit size is normally sufficiently small so as to provide a smooth surface finish.

One type of abrading tool which is disclosed by the prior art utilizes an abrasive member and a carbide shoe or utilizes two or more abrasive members mounted for radial movement with respect to each other so that the tool can be inserted within the hole and then expanded to perform the machining operation as the tool is rotated. Machining takes place within the hole as the expanded tool is rotated. Such tools are disclosed by U.S. Pat. Nos. 1,841,343; 1,874,856; 1,903,343; 1,910,658; and 1,960,555.

Another type of abrading tool incorporates a sleeve having an axial slit which has a circumferential component of about 360 degrees or less. An abrasive or lapping compound can be supplied to the sleeve during tool rotation to perform abrading by what is referred to as lapping. Also, an abrasive grit can be secured to the sleeve to perform the abrading as the tool is rotated. Mounting of the sleeve on a tapered arbor and axial positioning therealong allows the diameter of the sleeve to be controlled as the width of the slit in the sleeve varies according to the axial position. Such tools are disclosed by U.S. Pat. Nos. 2,341,094 and 3,462,887.

Other abrading tools are disclosed by U.S. Pat. Nos. 604,933; 1,906,190; 3,324,607; and 3,828,489.

It is very important that the abrading tools are of precise sizes so that the holes are machined to the required diameters. Also, the abrasive surface of rotatable abrading tools wears during use. Some provision for compensating for such wear is advantageous in order to increase tool life during which holes can be finished and sized to the same diameter.

DISCLOSURE OF THE INVENTION

Objects of the invention are to provide an improved expandable abrading tool for use in sizing and finishing holes, to provide an improved abrasive insert for use with the tool, and to provide washers of a frustoconical shape having outer abrasive edges which are used to make up the insert.

In carrying out the above objects, the abrading tool includes a rotatable arbor which extends through aligned openings in the washers that make up the abrasive insert. Each washer has a round outer edge including an abrasive secured thereto for performing the cutting operation upon tool rotation. The washers each have a frustoconical shape that points toward one end of the abrasive insert. A threaded clamp on the arbor provides a means for clamping the ends of the insert so as to flatten the washers and thereby control the diameters of the washers. The insert can be initially sized to a precise diameter before the first use and can be adjusted when required to compensate for wear of the abrasive.

The preferred construction of the arbor includes an outer mounting surface which extends through the insert between a fixed flange and a threaded portion of the arbor clamp. An engagement nut and a jam nut are received on the threaded portion of the arbor so as to cooperate with the arbor flange in clamping the insert and controlling the washer diameters. Leading and trailing ends of the abrasive insert are tapered so as to facilitate proper alignment of the tool during the initial entry into the hole being machined and upon reverse tool movement back through the hole.

Two embodiments of the tool disclosed each have inserts incorporating washers and spacers stacked in an alternating relationship. The spacers as well as the washers have a frustoconical shape which is flattened by the clamping action of the arbor to increase the diameters of the washer outer surfaces in order to initially size the insert and subsequently compensate for wear of the abrasive. In one embodiment the spacers have a smaller diameter than the washers and are made entirely of metal with a thin outer plastic coating sprayed onto their outer edges and onto the adjacent sides of the washers. In another embodiment the spacers are made of an inner metal member and an outer ring of a suitable nonconductive material. A third embodiment disclosed has an abrasive insert incorporating washers with opposite axial sides that are directly engaged with the adjacent washers.

The washers are also provided with flutes in the outer surfaces thereof on which the abrasive is secured. Preferably, a plurality of the flutes are ground into each washer spaced circumferentially about the central opening thereof in which the arbor mounting surface is received. The flutes decrease the clamping force necessary to flatten the washers and thereby control the washer diameter. Alignment of the flutes in the washers with each other also provides flutes along the length of the insert so that machined chips can pass therealong for removal from the hole as the tool is rotated. The embodiments which include spacers between the washers also have flutes formed in the spacers and aligned with the washer flutes.

The washers are stamped from planar stock of a suitable spring metal so as to have a tendency to return to the frustoconical shape in opposition to the clamping force. Preferably, a suitable copper alloy such as bronze with a component such as beryllium is used to make the washers. The copper alloy washers can be flattened by a smaller clamping force than is required with spring steel. The outer edges of the stamped washers are ground either singly or together with each other in a stacked relationship to a round cylindrical shape. An abrasive is then secured to the outer edges of the washers, preferably by a metal plating process that secures abrasive grits to the edges by a metal matrix such as nickel that is plated onto the washers. It should be noted that the washers with the abrasive secured thereto can be stocked without being stacked to make up the insert. Stacking of the washers when an insert is required is easily accomplished. Different size inserts can be made by stocking different size washers.

The objects, features, and advantages of the present invention are readily apparent from the following description of the best mode for practicing the invention taken together with the accompanying drawings.

BEST MODE FOR CARRYING OUT THE INVENTION

Figure 1:
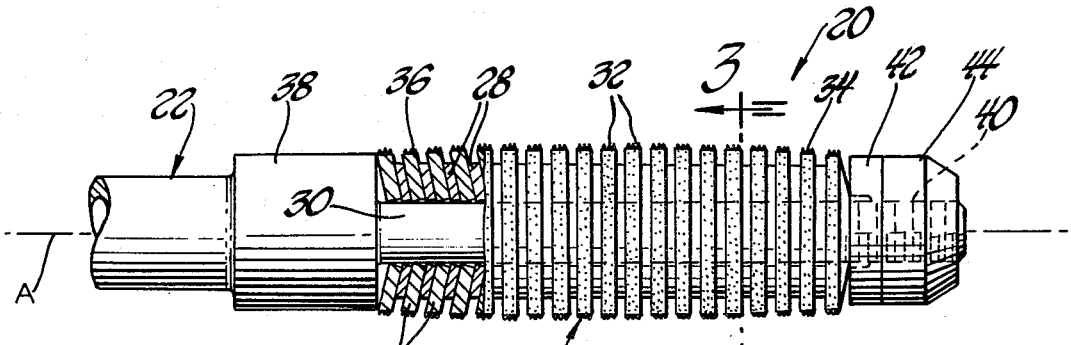
FIG. 1 is a side elevation view taken partially in section of an expandable abrading tool which is constructed according to the present invention and includes an abrasive insert of the invention mounted on a rotatable arbor.
Figure 5:
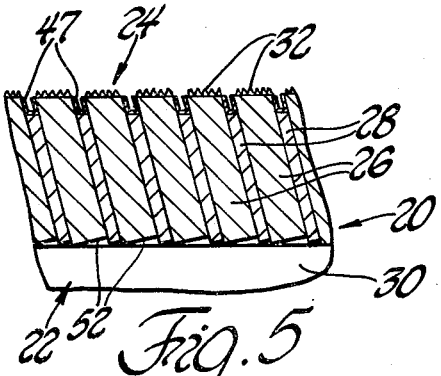
FIG. 5 is a partially sectioned view taken generally along line 5—5 of FIG. 3 and further illustrates the abrasive insert thereof.
Figure 3:
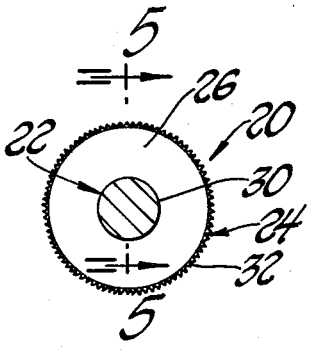
FIG. 3 is a cross sectional view through the tool and abrasive insert of FIG. 1 taken along line 3—3 thereof and further illustrates washers which are constructed according to the invention and utilized to make up the abrasive insert.

Referring to FIGS. 1, 3, and 5 of the drawings, an abrading tool indicated collectively by 20 is constructed according to the present invention and includes a rotatable arbor 22 and an abrasive insert 24 which is mounted on the arbor. Abrasive insert 24 includes a plurality of washers 26 stacked in an alternating relationship with washer-shaped spacers 28 of a slightly smaller diameter. Aligned central openings in the washers 26 and the spacers 28 receive an elongated arbor shank which includes a cylindrical mounting surface 30 that engages the washers and the spacers. Each of the washers 26 includes a round outer surface (see also FIG. 3) on which an abrasive 32 is secured. Washers 26 as well as the spacers 28 each have a frustoconical shape which points toward a leading tapered end 34 of the insert away from a trailing tapered end 36 of the insert.

Tool arbor 22 shown in FIG. 1 includes a fixed flange 38 that engages the trailing end 36 of the abrasive insert 24 in the mounted relationship shown. The shank on which the arbor mounting surface 30 is provided includes a distal end portion 40 that is threaded to receive an engagement nut 42 and a jam nut 44. Nut 42 is threaded to the left in order to engage the leading end 34 of the abrasive insert and to thereby cooperate with the flange 38 in securing the abrasive insert on the arbor for use. Jam nut 44 is threaded against the engagement nut 42 in order to prevent unthreading rotation during use. Threading the nut 42 further to the left flattens the washers and spacers 26 and 28 in order to increase the diameters of the washer outer surfaces on which the abrasive 32 is secured. This flattening allows the insert to be accurately sized for its initial use and adjusted to compensate for wear of the abrasive 32.

During use the tool 20 shown in FIG. 1 is rotated about its central axis of rotation A and moved axially therealong so that the leading end 34 of the abrasive insert 24 is initially received within a hole to be machined. Continued rotation of the tool takes place accompanied by further axial insertion thereof into the hole until the insert 24 has passed all the way through the hole and completed the machining operation. Subsequently, the tool is pulled out of the hole as it continues to rotate and the trailing tapered end 36 of the insert 24 then guides the tool without causing any malformation of the finished surface within the hole. After a predetermined number of machining operations, the nut 42 is threadedly adjusted to flatten the washers 26 the required extent in order to compensate for wear of the abrasive 32.

Figure 2:
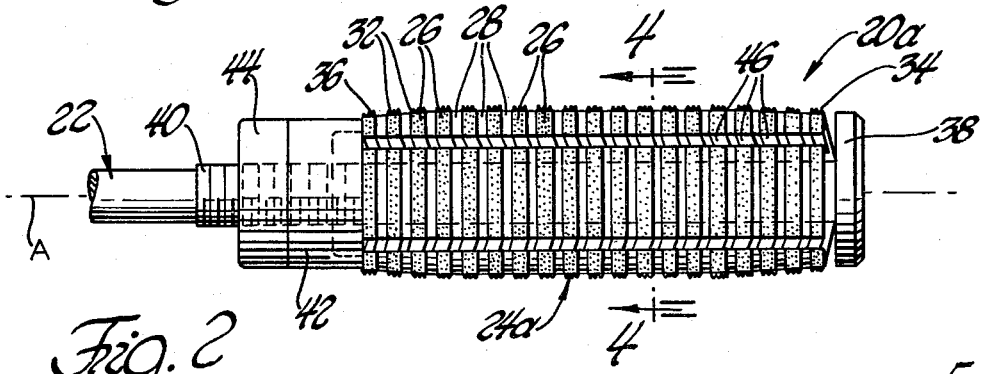
FIG. 2 is a side elevation view of another embodiment of the abrading tool and abrasive insert thereof which are constructed according to the present invention.
Figure 6:
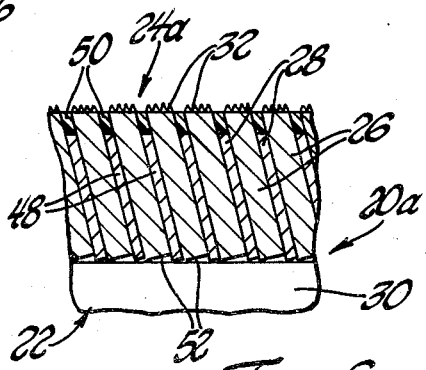
FIG. 6 is a sectional view taken generally along line 6—6 of FIG. 4 and further illustrates the abrasive insert thereof.
Figure 4:
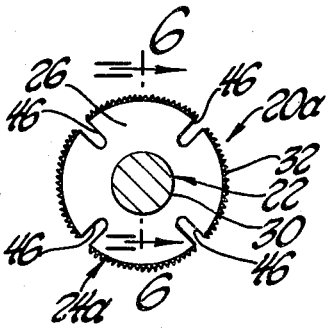
FIG. 4 is a cross sectional view through the tool and abrasive insert of FIG. 2 taken along line 4—4 thereof and further illustrates another embodiment of the washers which are constructed according to the invention and utilized to make up the abrasive insert.
Figure 1:
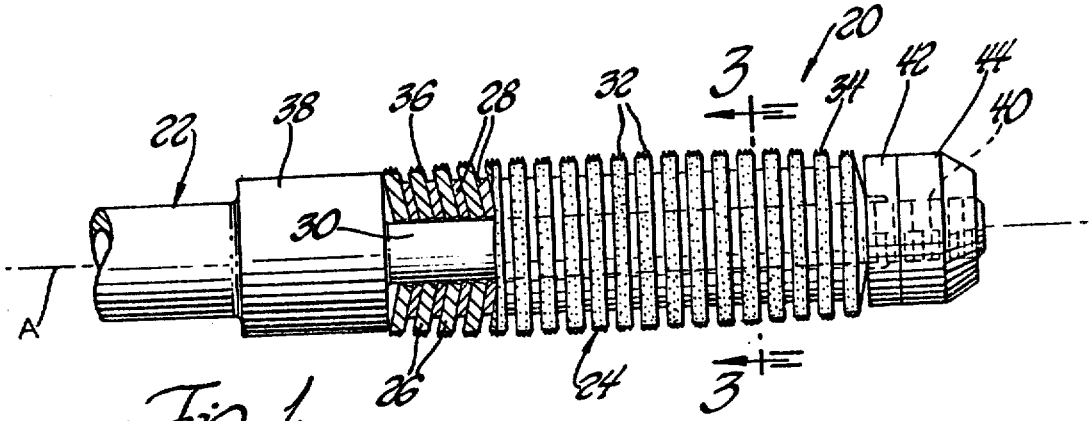
Figure 2:
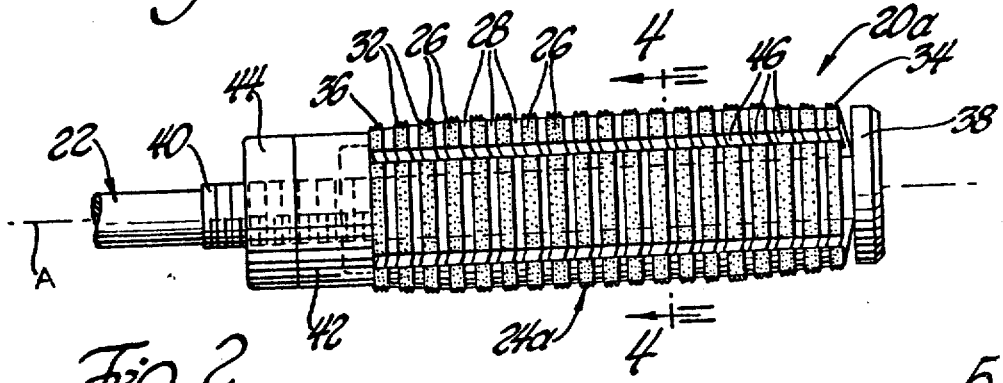
Figure 5:
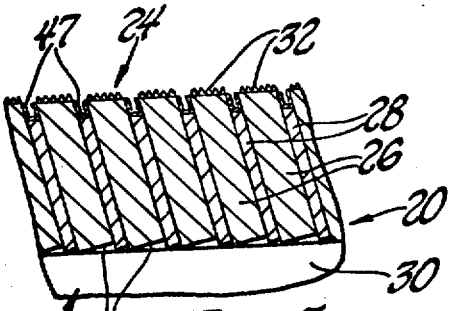
Figure 3:
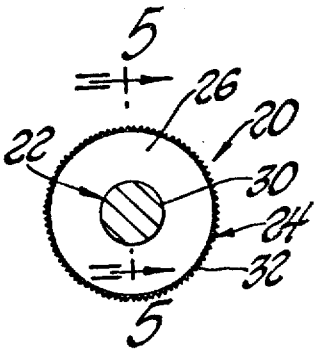
Figure 7:
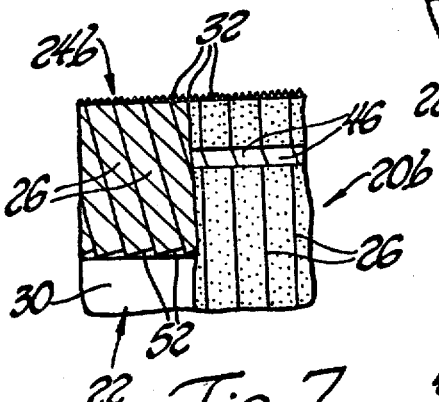
Figure 6:
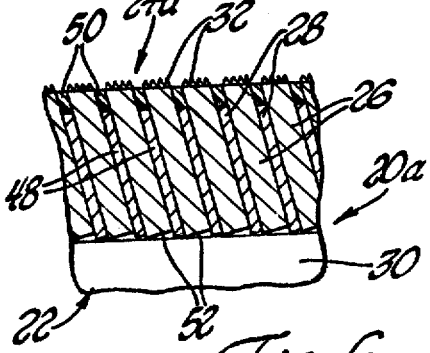
Figure 4:
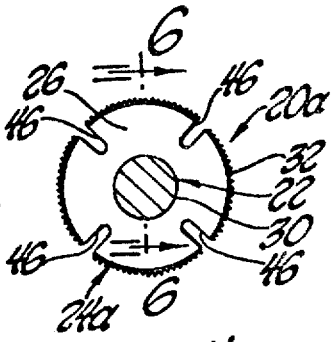

Referring to FIGS. 2, 4 and 6, another embodiment of the tool is indicated collectively by reference numeral 20*a* and is constructed generally the same as the previously described embodiment, except as will be noted, so that it is deemed appropriate to apply the same reference numerals. Likewise, much of the previous discussion is applicable to the construction of this tool embodiment as well.

Tool 20*a* as shown in FIG. 2 includes an arbor 22 whose fixed flange 38 is located adjacent the leading tapered end 34 of the abrasive insert 24*a* and whose threaded portion 40 and cooperable nuts 42 and 44 are located adjacent the tapered trailing end 36 of the abrasive insert. Flange 38 and the arbor threaded portion 40 and its nuts 42 and 44 thus occupy opposite axial positions as in the tool 20 of FIG. 1 but cooperate in the same way to provide the flattening of the washers 26 that controls the diameter of the insert. Also, each of the washers 26 and spacers 28 includes at least one flute 46 which is aligned with the other flutes to provide a continuous flute along the length of the insert. Preferably, each washer 26 and spacer 28 includes a plurality of the flutes spaced circumferentially about the central opening thereof which is engaged with the arbor mounting surface 30. Flutes 46 are shown arranged in a straight line relationship along the length of the insert and provide a path for machined chips to be removed. Flutes 46 also lessen the clamping force required to flatten the washers and spacers in order to compensate for the wear of the abrasive 32.

Abrasive insert 24 includes spacers 28 which, as best seen in FIG. 5, are stamped from a unitary piece of metal. Plastic 47 is sprayed onto the insert after stacking of the washers 26 and spacers 28 and the insert is then ground to the shape shown such that the plastic is removed from the outer edges of the washers. The remaining plastic 47 on the outer edges of the spacers and the outer sides of the washers prevents the plating, which is subsequently used to secure the abrasive 32, from bridging between the washers in a manner that could inhibit the washer flattening. The spacers 28 of the abrasive insert 24*a*, as best seen in FIG. 6, include an inner unitary metal member 48 of an annular shape and an outer nonconductive plastic or rubber ring 50. The rings 50 also allow the abrasive grits to be secured to the washers 26 by a metal plating process with the washers and spacers assembled in the stacked relationship shown. No surface is plated on the insert extending between the adjacent washers. Such a bridging plated surface could inhibit relative movement between the washers as they are flattened. Of course, it is also possible to make the spacers 28 of the insert 24 entirely from a nonconductive material so that the plating process which secures the abrasive 32 to the washers can be performed with the spacers located between the washers in the alternating stacked relationship shown.

Figure 7:
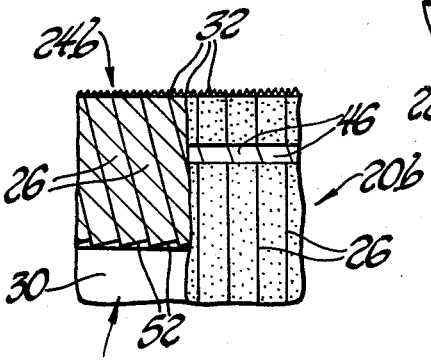
FIG. 7 is a view of another embodiment of the tool and abrasive insert thereof taken in a direction similar to FIGS. 5 and 6 but shown partially in full body illustration.

Another embodiment **24*b* of the abrasive insert is shown in FIG. 7 as including washers 26 having opposite axial sides which are directly engaged with the adjacent washers. Securement of the abrasive 32 to the round outer edges of the washers 26 must be performed before the washers are engaged with each other in the stacked relationship shown so as to prevent any plated surface from extending between two adjacent washers and thereby inhibiting the flattening of the washers which is used to initially size the insert and compensate for wear of the abrasive. After securement of the abrasive 32, the washers 26 are stacked against each other as shown on the outer mounting surface 30 of the arbor and clamped in the same manner described previously ready for use. A plurality of circumferentially spaced flutes 46 on the outer surface of each washer are arranged in axially aligned sets to provide flutes along the length of the insert 24*b*. Leading and trailing ends of the insert 24*b*** are tapered in the same manner as the other two embodiments so as to facilitate tool alignment during the initial insertion into a hole being machined and during the reverse movement back through the hole after the machining has been completed.

Washers 26 on which the abrasive 32 is secured are made by a stamping process from planar stock of a suitable spring metal so as to have a tendency to return to the frustoconical shape in opposition to the clamping force. Preferably, a copper alloy such as bronze which has a component like beryllium is used. The copper alloy washers can be flattened by a smaller clamping force than is required with spring steel. After the stamping process, the washer has its frustoconical shape and includes an inner annular edge 52 which is also a frustoconical shape. The outer annular edge of the washer 26 then likewise has a frustoconical shape which is parallel to the surface 52. The washers 26 are then mounted on a suitable mandrel or arbor and ground so that their outer edges are cylindrical. Flutes 46 are also ground into the washers after the outer edges thereof are ground to the cylindrical shape.

Abrasive 32, which may be diamonds or borazon, is secured to the ground outer edges of the washers by a plating process or any other suitable manner of attachment. As previously described, the washers must either be plated individually or separated by a nonconducting surface if they are stacked in order to prevent any plated surface from extending between the adjacent washers and inhibiting the washer flattening that compensates for wear of the abrasive. It should be noted that the flattening of the washers to initially size the insert or subsequently compensate for wear of the abrasive does not necessarily require the washers to move all the way to a planar condition, but only requires that the washers move from the frustoconical position toward the planar condition.

Flutes 46, as previously mentioned, provide a path for the machined chips to be removed from the cutting tool during use and also lessen the clamping force necessary for flattening the washers. While the washers and spacers can be made from any spring material such as spring steel, the copper alloy composition of the washers is preferable over steel material because of the smaller clamping force necessary to flatten the washers.

It should be noted that the washers 26 with the abrasive 32 secured thereto can be stacked and assembled to make up an insert when required. Different size inserts can be easily made by stocking different size washers. Tapered ends on the inserts can be made by washers whose outer surfaces are ground to a frustoconical shape before securing the abrasive or by washers with cylindrical outer edges of stepped diameters between adjacent washers.

While preferred embodiments of the best mode for carrying out the invention have been herein described in detail, those skilled in the art will recognize various alternative embodiments and ways of practicing the present invention as defined by the following claims.

I claim:

1. An abrading tool comprising: an arbor having a central axis of rotation and an outer mounting surface; an abrasive insert having leading and trailing ends; at least the leading end of the insert being tapered; the insert including a plurality of washers and spacers stacked in an axially alternating relationship and having aligned central openings through which the arbor extends to mount the insert thereon; said washers and spacers each having a frustoconical shape that points toward one end of the insert; each washer having opposite axial sides and a round outer edge that extends between the axial sides thereof; the round outer edge of each washer including an abrasive secured thereto for performing a cutting operation upon tool rotation; each spacer having opposite axial sides engaged with the adjacent washers so that each washer is spaced axially from the adjacent washers; each spacer also having a nonconductive outer edge at which the outer edges of the adjacent washers are spaced axially from each other; a clamp on the arbor for adjustably clamping the ends of the insert with a clamping force that can be increased to flatten the frustoconical shapes of the washers and the spacers and thereby control the diameters of the outer edges on the washers at which cutting takes place; and the outer edge of each washer and spacer including a plurality of flutes for decreasing the clamping force required to flatten the washers and spacers, and said flutes being aligned along the length of the insert so as to provide a path for machined chips to be removed.

2. A tool as in claim 1 wherein each spacer includes an inner unitary metal member of an annular shape and an outer nonconductive ring.

3. A tool as in claims 1 or 2 wherein the trailing end of the abrasive insert is tapered.

* * * * *

UNITED STATES PATENT AND TRADEMARK OFFICE

CERTIFICATE OF CORRECTION

PATENT NO. : 4,188,755

DATED : February 19, 1980

INVENTOR(S) : Paul Fitzpatrick

It is certified that error appears in the above—identified patent and that said Letters Patent is hereby corrected as shown below:

In the original ribbon patent grant, the eleven (11) sheets of drawings erroneously included from U.S Patent 4,188,775 are hereby cancelled, and the correct single sheet of drawings attached is hereby substituted therefor.

Signed and Sealed this

*First* Day of *July 1980*

[SEAL]

*Attest:*

SIDNEY A. DIAMOND

*Attesting Officer*

*Commissioner of Patents and Trademarks*